US010283042B2

(12) United States Patent
Yang et al.

(10) Patent No.: US 10,283,042 B2
(45) Date of Patent: May 7, 2019

(54) PIXEL DRIVING CIRCUIT, PIXEL DRIVING METHOD, AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xue Dong, Beijing (CN); Haisheng Wang, Beijing (CN); Xiaochuan Chen, Beijing (CN); Yingming Liu, Beijing (CN); Xiaoliang Ding, Beijing (CN); Weijie Zhao, Beijing (CN); Rui Xu, Beijing (CN); Lei Wang, Beijing (CN); Changfeng Li, Beijing (CN); Wei Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/165,402

(22) Filed: May 26, 2016

(65) Prior Publication Data

US 2017/0018226 A1 Jan. 19, 2017

(30) Foreign Application Priority Data

Jul. 16, 2015 (CN) ..... 2015 1 0419137

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
CPC ..... G09G 3/30–3/3291; G09G 2310/0264; G09G 2320/0233; G09G 2330/028
(Continued)

(56) References Cited

U.S. PATENT DOCUMENTS 9,330,603 B2 * 5/2016 Kwak ..... G09G 3/3266
2007/0063993 A1 * 3/2007 Shishido ..... G09G 3/3241 345/175

(Continued)

FOREIGN PATENT DOCUMENTS

CN 201853000 U 6/2011
CN 104111538 A 10/2014

(Continued)

OTHER PUBLICATIONS

First Office Action dated Dec. 30, 2016 in corresponding Chinese Application No. 201510419137.5.

(Continued)

*Primary Examiner* — Stephen G Sherman
(74) *Attorney, Agent, or Firm* — Nath, Goldberg & Meyer; Joshua B. Goldberg

(57) ABSTRACT

The present invention provides a pixel driving circuit, a pixel driving method, and a display device. The pixel driving circuit comprises a driving transistor, a light-emitting device and a threshold compensation unit; a control electrode, a first electrode and a second electrode of the driving transistor are all connected with the threshold compensation unit; the threshold compensation unit is connected with a data line, a first power supply terminal, and a first terminal of the light-emitting device. In the technical solution of the present (Continued)

invention, by providing the sum of the data voltage and the threshold voltage of the driving transistor to the control electrode of the driving transistor, a driving current generated by the driving transistor is independent of the threshold voltage of the driving transistor, so as to prevent the driving current from being influenced by non-uniformity and shift of the threshold voltage.

11 Claims, 4 Drawing Sheets

(52) U.S. Cl.
CPC ..... *G09G 2300/0861* (2013.01); *G09G 2310/0262* (2013.01); *G09G 2320/045* (2013.01)

(58) Field of Classification Search
USPC ..... 345/76–83; 315/169.3
See application file for complete search history.

(56) References Cited

U.S. PATENT DOCUMENTS

| | | | | |
|---|---|---|---|---|
| 2007/0285509 | A1 | 12/2007 | Lee | |
| 2010/0149317 | A1 | 6/2010 | Matthews | |
| 2011/0063198 | A1* | 3/2011 | Chung | G09G 3/3233 345/82 |

FOREIGN PATENT DOCUMENTS

| | | | |
|---|---|---|---|
| CN | 104157244 | A | 11/2014 |
| CN | 104282263 | A | 1/2015 |
| CN | 104575394 | A | 4/2015 |
| CN | 104575398 | A | 4/2015 |
| JP | 2004-118140 | A | 4/2004 |

OTHER PUBLICATIONS

First Office Action dated Dec. 19, 2016 in corresponding Chinese Application No. 201510451026.2.

* cited by examiner

PIXEL DRIVING CIRCUIT, PIXEL DRIVING METHOD, AND DISPLAY DEVICE

FIELD OF THE INVENTION

The present invention relates to the field of display technology, and particularly relates to a pixel driving circuit, a pixel driving method, and a display device.

BACKGROUND OF THE INVENTION

Active matrix organic light emitting diode (AMOLED) panels are used more and more widely. A pixel display device of an AMOLED panel is an organic light-emitting diode (OLED), and the AMOLED panel can emit light in such a way that a driving thin film transistor generates a driving current in a saturation state and the OLED is driven by said driving current to emit light. FIG. 1 is a schematic structural diagram of a basic pixel driving circuit in the prior art. As shown in FIG. 1, the existing basic pixel driving circuit adopts a 2T1C circuit comprising two thin film transistors (a switching transistor T0 and a driving transistor DTFT) and a storage capacitor C.

However, because threshold voltages Vth of the driving transistors DTFT on a display substrate have poor uniformity in a conventional low-temperature polycrystalline silicon process, and may shift during use, when the switching transistors T0 are controlled to be turned on by scan lines Scan to input the same data voltage Vdata to the driving transistors DTFT, different driving currents will be generated due to different threshold voltages of the driving transistors DTFT, thereby resulting in poor brightness uniformity of the OLEDs.

SUMMARY OF THE INVENTION

The present invention provides a pixel driving circuit, a pixel driving method, and a display device, which can effectively eliminate an influence of a threshold voltage of a driving transistor on a driving current of a light-emitting device, thereby effectively improving brightness uniformity of an AMOLED panel in a display device.

In order to achieve the above object, the present invention provides a pixel driving circuit, comprising a driving transistor, a light-emitting device and a threshold compensation unit; wherein a control electrode, a first electrode and a second electrode of the driving transistor are all connected with the threshold compensation unit;

the threshold compensation unit is connected with a data line, a first power supply terminal, and a first terminal of the light-emitting device;

a second terminal of the light-emitting device is connected with a second power supply terminal;

the driving transistor is used for driving the light-emitting device to emit light; and the threshold compensation unit is used for providing a control voltage to the control electrode of the driving transistor when the driving transistor drives the light-emitting device to emit light, the control voltage being equal to the sum of a threshold voltage of the driving transistor and a data voltage of the data line.

Optionally, the threshold compensation unit comprises a storage capacitor, a reset module, a charging module and a light emission control module;

the reset module is connected with a second terminal of the storage capacitor, and is used for resetting the second terminal of the storage capacitor;

the charging module is connected with the data line, the first electrode and the second electrode of the driving transistor, and the second terminal of the storage capacitor, and is used for charging the second terminal of the storage capacitor to the control voltage;

the light emission control module is connected with the first power supply terminal, the first electrode and the second electrode of the driving transistor, and the first terminal of the light-emitting device, and is used for, when the driving transistor drives the light-emitting device to emit light, connecting the first electrode of the driving transistor to the first power supply terminal, and connecting the second electrode of the driving transistor to the first terminal of the light-emitting device; and a first terminal of the storage capacitor is grounded or is connected with a third power supply terminal, and the second terminal of the storage capacitor is connected with the control electrode of the driving transistor.

Optionally, the reset module comprises a first switching transistor; and a control electrode of the first switching transistor is connected with a first control signal line, a first electrode of the first switching transistor is connected with a fourth power supply terminal, and a second electrode of the first switching transistor is connected with the second terminal of the storage capacitor.

Optionally, the fourth power supply terminal and the first power supply terminal are the same power supply terminal.

Optionally, the charging module comprises a second switching transistor and a third switching transistor;

a control electrode of the second switching transistor is connected with a second control signal line, a first electrode of the second switching transistor is connected with the data line, and a second electrode of the second switching transistor is connected with the second electrode of the driving transistor; and a control electrode of the third switching transistor is connected with the second control signal line, a first electrode of the third switching transistor is connected with the first electrode of the driving transistor, and a second electrode of the third switching transistor is connected with the second terminal of the storage capacitor.

Optionally, the light emission control module comprises a fourth switching transistor and a fifth switching transistor;

a control electrode of the fourth switching transistor is connected with a third control signal line, a first electrode of the fourth switching transistor is connected with the first power supply terminal, and a second electrode of the fourth switching transistor is connected with the first electrode of the driving transistor; and a control electrode of the fifth switching transistor is connected with the third control signal line, a first electrode of the fifth switching transistor is connected with the second electrode of the driving transistor, and a second electrode of the fifth switching transistor is connected with the first terminal of the light-emitting device.

Optionally, all the switching transistors in the pixel driving circuit are N-type thin film transistors.

In order to achieve the above object, the present invention further provides a display device, comprising a pixel driving circuit which adopts the aforesaid pixel driving circuit.

In order to achieve the above object, the present invention further provides a pixel driving method, based on a pixel driving circuit adopting the aforesaid pixel driving circuit, and the pixel driving method comprises:

outputting a control voltage by the threshold compensation unit to the control electrode of the driving transistor, the control voltage being equal to the sum of the threshold voltage of the driving transistor and the data voltage of the data line, and driving the light-emitting device by the driving transistor under the control of the control voltage so as to emit light.

Optionally, the pixel driving method specifically comprises:

resetting the second terminal of the storage capacitor by the reset module;

charging the second terminal of the storage capacitor by the charging module to the control voltage; and outputting the control voltage by the charging module to the control electrode of the driving transistor, and connecting the first power supply terminal to the first electrode of the driving transistor and connecting the second electrode of the driving transistor to the first terminal of the light-emitting device by the light emission control module.

Optionally, the pixel driving method specifically comprises:

in a reset stage, turning on the first switching transistor, and turning off the second switching transistor, the third switching transistor, the fourth switching transistor and the fifth switching transistor;

in a charging stage, turning on the second switching transistor and the third switching transistor, and turning off the first switching transistor, the fourth switching transistor and the fifth switching transistor; and in a display stage, turning on the fourth switching transistor and the fifth switching transistor, and turning off the first switching transistor, the second switching transistor and the third switching transistor.

The present invention has the following beneficial effects:

In a pixel driving circuit, a pixel driving method and a display device provided by the present invention, by providing the sum of a data voltage and a threshold voltage of a driving transistor to a control electrode of the driving transistor when the driving transistor drives a light-emitting device to emit light, a driving current generated by the driving transistor can be independent of the threshold voltage of the driving transistor, so as to prevent the driving current flowing through the light-emitting device from being influenced by non-uniformity and shift of the threshold voltage, thereby effectively improving uniformity of the driving current flowing through the light-emitting device.

DETAILED DESCRIPTION OF THE EMBODIMENTS

In order to make those skilled in the art better understand the technical solutions of the present invention, a pixel driving circuit, a pixel driving method and a display device provided by the present invention will be further described in detail below in conjunction with the accompanying drawings.

Embodiment 1

Figure 1:
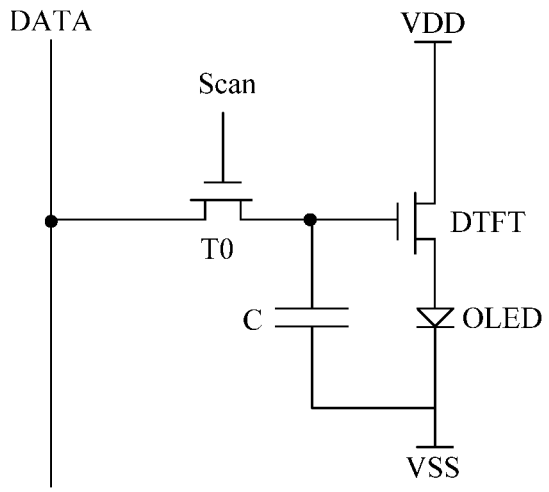
FIG. 1 is a schematic structural diagram of a basic pixel driving circuit in the prior art.
Figure 2:
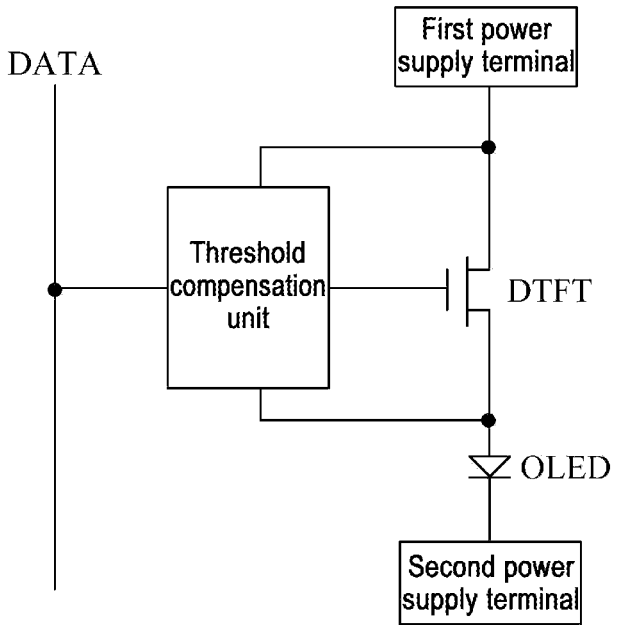
FIG. 2 is a schematic structural diagram of a pixel driving circuit provided in Embodiment 1 of the present invention.

FIG. 2 is a schematic structural diagram of a pixel driving circuit provided in Embodiment 1 of the present invention. As shown in FIG. 2, the pixel driving circuit comprises a driving transistor DTFT, a light-emitting device and a threshold compensation unit. A control electrode, a first electrode and a second electrode of the driving transistor DTFT are all connected with the threshold compensation unit, the threshold compensation unit is connected with a data line DATA, a first power supply terminal, and a first terminal of the light-emitting device, and a second terminal of the light-emitting device OLED is connected with a second power supply terminal. The driving transistor DTFT is used for driving the light-emitting device OLED to emit light; and the threshold compensation unit is used for providing a control voltage to the control electrode of the driving transistor DTFT when the driving transistor DTFT drives the light-emitting device OLED to emit light, wherein, the control voltage is equal to the sum of a threshold voltage of the driving transistor DTFT and a data voltage of the data line DATA.

In this embodiment, the first power supply terminal is used for providing a working voltage Vdd, and the second power supply terminal is used for providing a reference voltage Vss.

It should be noted that the light-emitting device OLED in this embodiment may be a light-emitting device driven by current in the prior art, such as a light emitting diode (LED) or an organic light emitting diode (OLED), and an OLED is taken as an example for illustration in this embodiment.

In the technical solution of the present invention, by providing the sum of the data voltage and the threshold voltage of the driving transistor DTFT to the control electrode of the driving transistor DTFT when the driving transistor DTFT drives the light-emitting device to emit light, a driving current generated by the driving transistor DTFT can be independent of the threshold voltage of the driving transistor DTFT, so as to eliminate an influence of the threshold voltage of the driving transistor DTFT on the driving current of the light-emitting device OLED, thereby effectively improving brightness uniformity of the light-emitting device OLED in a display device.

Embodiment 1 of the present invention further provides a pixel driving method, based on a pixel driving circuit adopting the aforesaid pixel driving circuit shown in FIG. 2, and the pixel driving method comprises:

step S: outputting a control voltage by the threshold compensation unit to the control electrode of the driving transistor, the control voltage being equal to the sum of the threshold voltage of the driving transistor and the data voltage of the data line, and driving, by the driving transistor, the light-emitting device under the control of the control voltage to emit light.

In the pixel driving circuit and the pixel driving method provided by Embodiment 1 of the present invention, i by writing the sum of the data voltage and the threshold voltage of the driving transistor to the control electrode of the driving transistor when the driving transistor drives the light-emitting device to emit light, the driving current generated by the driving transistor can be independent of the threshold voltage of the driving transistor, so as to prevent the driving current flowing through the light-emitting device from being influenced by non-uniformity and shift of the threshold voltage, thereby effectively improving uniformity of the driving current flowing through the light-emitting device.

Embodiment 2

Figure 3:
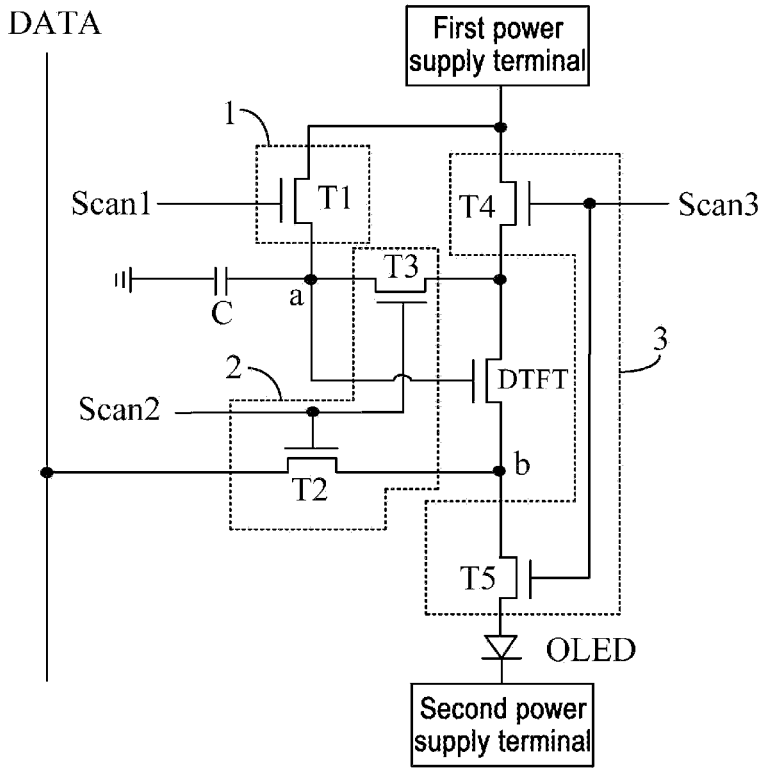
FIG. 3 is a schematic structural diagram of a pixel driving circuit provided in Embodiment 2 of the present invention.

FIG. 3 is a schematic structural diagram of a pixel driving circuit provided in Embodiment 2 of the present invention. As shown in FIG. 3, the pixel driving circuit is based on the pixel driving circuit shown in FIG. 2. Specifically, the threshold compensation unit comprises a storage capacitor C, a reset module 1, a charging module 2 and a light emission control module 3, wherein, the reset module 1 is connected with a second terminal of the storage capacitor C, the charging module 2 is connected with the data line DATA, the first electrode and the second electrode of the driving transistor DTFT, and the second terminal of the storage capacitor C, the light emission control module 3 is connected with the first power supply terminal, the first electrode and the second electrode of the driving transistor DTFT, and the first terminal of the light-emitting device OLED, a first terminal of the storage capacitor C is grounded or is connected with a third power supply terminal, and the second terminal of the storage capacitor C is connected with the control electrode of the driving transistor DTFT. The reset module 1 is used for resetting the second terminal of the storage capacitor C; the charging module 2 is used for charging the second terminal of the storage capacitor C to the control voltage after the second terminal of the storage capacitor C is reset; and the light emission control module 3 is used for, when the driving transistor DTFT drives the light-emitting device OLED to emit light, connecting the first power supply terminal to the first electrode of the driving transistor DTFT, and connecting the second electrode of the driving transistor DTFT to the first terminal of the light-emitting device OLED.

It should be noted that the third power supply terminal is used for providing a stable voltage. In this embodiment, by connecting the first terminal of the storage capacitor C with the third power supply terminal, a voltage of the first terminal of the storage capacitor C is maintained at a fixed value. In practical operation, the first terminal of the storage capacitor C is preferably grounded (see FIG. 3) in order to reduce power consumption of the entire circuit. This embodiment does not provide a drawing corresponding to the case in which the first terminal of the storage capacitor C is connected with the third power supply terminal.

Further optionally, the reset module 1 comprises a first switching transistor T1, wherein a control electrode of the first switching transistor T1 is connected with a first control signal line Scan1, a first electrode of the first switching transistor T1 is connected with a fourth power supply terminal, and a second electrode of the first switching transistor T1 is connected with the second terminal of the storage capacitor C.

It should be noted that the fourth power supply terminal and the first power supply terminal are the same power supply terminal in FIG. 3, so as to effectively decrease installations of the power supply terminals, thereby reducing circuit complexity.

Optionally, the charging module 2 comprises a second switching transistor T2 and a third switching transistor T3, wherein a control electrode of the second switching transistor T2 is connected with a second control signal line Scan2, a first electrode of the second switching transistor T2 is connected with the data line DATA, and a second electrode of the second switching transistor T2 is connected with the second electrode of the driving transistor DTFT; and a control electrode of the third switching transistor T3 is connected with the second control signal line Scan2, a first electrode of the third switching transistor T3 is connected with the first electrode of the driving transistor DTFT, and a second electrode of the third switching transistor T3 is connected with the second terminal of the storage capacitor C.

Optionally, the light emission control module comprises a fourth switching transistor T4 and a fifth switching transistor T5, wherein a control electrode of the fourth switching transistor T4 is connected with a third control signal line Scan3, a first electrode of the fourth switching transistor T4 is connected with the first power supply terminal, and a second electrode of the fourth switching transistor T4 is connected with the first electrode of the driving transistor DTFT; and a control electrode of the fifth switching transistor T5 is connected with the third control signal line Scan3, a first electrode of the fifth switching transistor T5 is connected with the second electrode of the driving transistor DTFT, and a second electrode of the fifth switching transistor T5 is connected with the first terminal of the light-emitting device OLED.

It should be noted that each of the driving transistor DTFT, the first switching transistor T1, the second switching transistor T2, the third switching transistor T3, the fourth switching transistor T4 and the fifth switching transistor T5 in this embodiment is independently selected from one of polysilicon thin film transistor, amorphous silicon thin film transistor, oxide thin film transistor and organic thin film transistor.

In this embodiment, a "control electrode" specifically refers to a gate of a transistor, a "first electrode" specifically refers to a source of the transistor, and correspondingly a "second electrode" specifically refers to a drain of the transistor. Of course, those skilled in the art should know that the "first electrode" and the "second electrode" can be interchanged.

Preferably, all the switching transistors in the pixel driving circuit are N-type thin film transistors in this embodiment, so that the same manufacturing process can be adopted to manufacture all of the aforesaid switching transistors simultaneously, thereby shortening a production cycle of the pixel driving circuit. It should be noted that it is merely a preferable technical solution in this embodiment that all the switching transistors in the pixel driving circuit are N-type thin film transistors, which imposes no limitation on the technical solutions of the present application.

A working process of the pixel driving circuit provided in this embodiment will be described in detail below in conjunction with the accompanying drawings. Description is given by taking the case in which the driving transistor DTFT, the first switching transistor T1, the second switching transistor T2, the third switching transistor T3, the fourth switching transistor T4 and the fifth switching transistor T5 are all N-type thin film transistors as an example.

Figure 4:
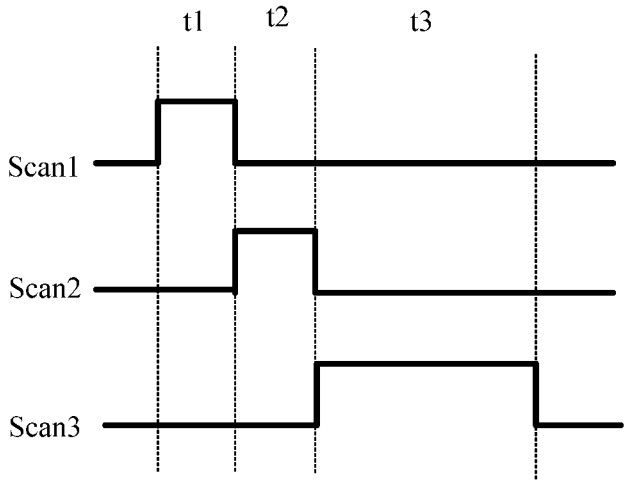
FIG. 4 is an operational timing diagram of the pixel driving circuit shown in FIG. 3.

FIG. 4 is an operational timing diagram of the pixel driving circuit shown in FIG. 3. As shown in FIG. 4, the working process of the pixel driving circuit includes three stages: a reset stage t1, a charging stage t2, and a display stage t3.

In the reset stage t1, the first control signal line Scan1 outputs a high level signal, the second control signal line Scan2 outputs a low level signal, and the third control signal line Scan3 outputs a low level signal. At this moment, the first switching transistor T1 is turned on, and the second switching transistor T2, the third switching transistor T3, the fourth switching transistor T4 and the fifth switching transistor T5 are turned off.

Figure 5:
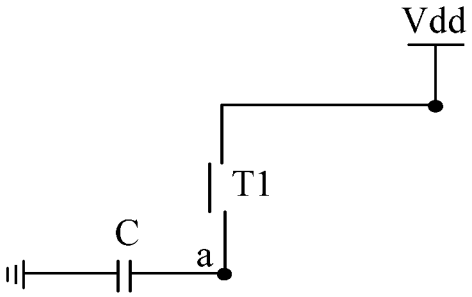
FIG. 5 is an equivalent circuit diagram of the pixel driving circuit shown in FIG. 3 in a reset stage.

FIG. 5 is an equivalent circuit diagram of the pixel driving circuit shown in FIG. 3 in the reset stage. As shown in FIG. 5, because the first switching transistor T1 is turned on, the working voltage Vdd provided by the first power supply terminal is transferred to the second terminal of the storage capacitor C through the first switching transistor T1, so as to reset the second terminal of the storage capacitor C (which can also be considered to reset the control electrode of the driving transistor DTFT), and a voltage at a node a is equal to Vdd at this moment.

In the charging stage t2, the first control signal line Scan1 outputs a low level signal, the second control signal line Scan2 outputs a high level signal, and the third control signal line Scan3 outputs a low level signal. At this moment, the second switching transistor T2 and the third switching transistor T3 are turned on, and the first switching transistor T1, the fourth switching transistor T4 and the fifth switching transistor T5 are turned off.

Figure 6:
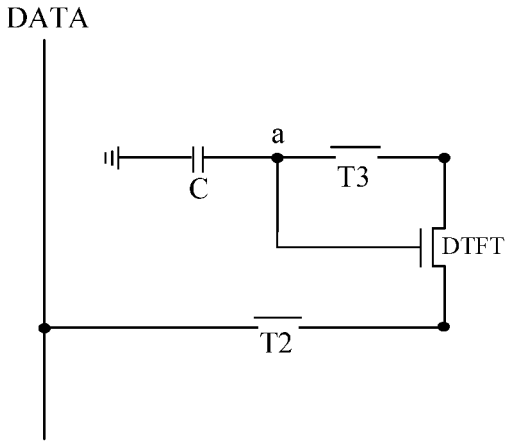
FIG. 6 is an equivalent circuit diagram of the pixel driving circuit shown in FIG. 3 in a charging stage.

FIG. 6 is an equivalent circuit diagram of the pixel driving circuit shown in FIG. 3 in the charging stage. As shown in FIG. 6, because the second switching transistor T2 is turned on, the data voltage Vdata of the data line DATA is transferred to a node b through the second switching transistor T2 and a voltage at the node b is changed to Vdata. At this moment, because a voltage of the control electrode of the driving transistor DTFT is equal to Vdd (the voltage at the node a is equal to Vdd), the driving transistor DTFT is turned on; meanwhile, because the third switching transistor T3 is turned on, the data line DATA is connected to the second terminal of the storage capacitor C through the second switching transistor T2, the driving transistor DTFT and the third switching transistor T3, so that the data line DATA begins to charge the second terminal of the storage capacitor C until the voltage of the second terminal of the storage capacitor C is increased to Vdata+Vth, wherein Vth is the threshold voltage of the driving transistor DTFT, and the driving transistor DTFT is turned off at this moment. After the charging, the voltage at the node a is changed to Vdata+Vth.

It should be noted that the driving transistor DTFT is turned on and generates a driving current in the charging stage, but the fifth switching transistor T5 is turned off, so that the driving current cannot flow through the OLED, and thus the light-emitting device does not emit light. In the charging stage, no electric current flows through the OLED because the fifth switching transistor T5 is turned off, which decreases life loss of the OLED indirectly.

In the display stage t3, the first control signal line Scan1 outputs a low level signal, the second control signal line Scan2 outputs a low level signal, and the third control signal line Scan3 outputs a high level signal. At this moment, the fourth switching transistor T4 and the fifth switching transistor T5 are turned on, and the first switching transistor T1, the second switching transistor T2 and the third switching transistor T3 are turned off.

Figure 7:
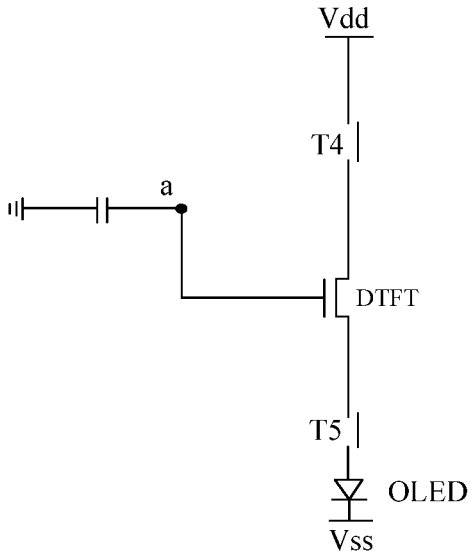
FIG. 7 is an equivalent circuit diagram of the pixel driving circuit shown in FIG. 3 in a display stage.

FIG. 7 is an equivalent circuit diagram of the pixel driving circuit shown in FIG. 3 in the display stage. As shown in FIG. 7, because the fourth switching transistor T4 is turned on, the working voltage Vdd provided by the first power supply terminal is transferred to the first electrode of the driving transistor DTFT through the fourth switching transistor T4, and the driving transistor DTFT is turned on again at this moment. The driving current I generated by the driving transistor DTFT can be obtained according to the following saturation driving current formula of the driving transistor DTFT:

$$\begin{aligned} I &= K*(Vgs-Vth)^2 \\ &= K*(Vdata+Vth-Vdd-Vth)^2 \\ &= K*(Vdata-Vdd)^2 \end{aligned}$$

wherein, K is a constant, and Vgs is a gate-source voltage of the driving transistor DTFT. It can be known from the above formula that the driving current I of the driving transistor DTFT is related to the working voltage Vdd provided by the first power supply terminal and the data voltage Vdata, but is independent of the threshold voltage Vth of the driving transistor DTFT.

In this embodiment, when the driving transistor DTFT drives the light-emitting device OLED to emit light, the driving current generated by the driving transistor DTFT is independent of the threshold voltage of the driving transistor DTFT, so as to prevent the driving current flowing through the light-emitting device OLED from being influenced by non-uniformity and shift of the threshold voltage, thereby effectively improving uniformity of the driving current flowing through the light-emitting device OLED.

Embodiment 2 of the present invention further provide a pixel driving method based on a pixel driving circuit adopting the aforesaid pixel driving circuit shown in FIG. 3, and the pixel driving method comprises:

step S1: resetting the second terminal of the storage capacitor by the reset module;

step S2: charging, by the charging module, the second terminal of the storage capacitor to the control voltage; and step S3: outputting the control voltage by the charging module to the control electrode of the driving transistor, and connecting the first power supply terminal to the first electrode of the driving transistor and connecting the second electrode of the driving transistor to the first terminal of the light-emitting device by the light emission control module.

It should be noted that steps S1, S2 and S3 correspond to the aforesaid reset stage, charging stage and display stage, respectively. Please refer to the aforesaid corresponding contents for specific processes thereof, which will not be repeated here.

In the pixel driving circuit and the pixel driving method provided by Embodiment 2 of the present invention, by charging the second terminal of the storage capacitor to the control voltage in the charging stage, and providing the sum of the data voltage and the threshold voltage of the driving transistor to the control electrode of the driving transistor in the display stage, the driving current generated by the driving transistor can be independent of the threshold voltage of the driving transistor, so as to prevent the driving current flowing through the light-emitting device from being influenced by non-uniformity and shift of the threshold voltage, thereby effectively improving uniformity of the driving current flowing through the light-emitting device.

Embodiment 3

Embodiment 3 of the present invention provides a display device, comprising a pixel driving circuit adopting the pixel driving circuit provided in the aforesaid Embodiment 1 or 2. Detailed description may refer to the aforesaid Embodiments 1 and 2, and is not provided here.

It should be understood that the foregoing implementations are merely exemplary implementations adopted for describing the principle of the present invention, but the present invention is not limited thereto. Those of ordinary skill in the art may make various variations and improvements without departing from the spirit and essence of the present invention, and these variations and improvements shall be considered to fall into the protection scope of the present invention.

The invention claimed is:

1. A pixel driving circuit, comprising a driving transistor, a light-emitting device and a threshold compensation unit; wherein a control electrode, a first electrode and a second electrode of the driving transistor are all connected with the threshold compensation unit;

the threshold compensation unit is connected with a data line, a first power supply terminal, and a first terminal of the light-emitting device;

a second terminal of the light-emitting device is connected with a second power supply terminal;

the driving transistor is used for driving the light-emitting device to emit light;

the threshold compensation unit is used for writing a control voltage to the control electrode of the driving transistor when the driving transistor drives the light-emitting device to emit light, the control voltage being equal to the sum of only a threshold voltage of the driving transistor and a data voltage of the data line.

2. The pixel driving circuit of claim 1, wherein, the threshold compensation unit comprises a storage capacitor, a reset module, a charging module and a light emission control module;

the reset module is connected with a second terminal of the storage capacitor, and is used for resetting the second terminal of the storage capacitor;

the charging module is connected with the data line, the first electrode and the second electrode of the driving transistor, and the second terminal of the storage capacitor, and is used for charging the second terminal of the storage capacitor to the control voltage;

the light emission control module is connected with the first power supply terminal, the first electrode and the second electrode of the driving transistor, and the first terminal of the light-emitting device, and is used for, when the driving transistor drives the light-emitting device to emit light, connecting the first electrode of the driving transistor to the first power supply terminal, and connecting the second electrode of the driving transistor to the first terminal of the light-emitting device; and a first terminal of the storage capacitor is grounded or is connected with a third power supply terminal, and the second terminal of the storage capacitor is connected with the control electrode of the driving transistor.

3. The pixel driving circuit of claim 2, wherein, the reset module comprises a first switching transistor; and a control electrode of the first switching transistor is connected with a first control signal line, a first electrode of the first switching transistor is connected with a fourth power supply terminal, and a second electrode of the first switching transistor is connected with the second terminal of the storage capacitor.

4. The pixel driving circuit of claim 3, wherein, the fourth power supply terminal and the first power supply terminal are the same power supply terminal.

5. The pixel driving circuit of claim 3, wherein, the charging module comprises a second switching transistor and a third switching transistor;

a control electrode of the second switching transistor is connected with a second control signal line, a first electrode of the second switching transistor is connected with the data line, and a second electrode of the second switching transistor is connected with the second electrode of the driving transistor; and a control electrode of the third switching transistor is connected with the second control signal line, a first electrode of the third switching transistor is connected with the first electrode of the driving transistor, and a second electrode of the third switching transistor is connected with the second terminal of the storage capacitor.

6. The pixel driving circuit of claim 5, wherein, the light emission control module comprises a fourth switching transistor and a fifth switching transistor;

a control electrode of the fourth switching transistor is connected with a third control signal line, a first electrode of the fourth switching transistor is connected with the first power supply terminal, and a second electrode of the fourth switching transistor is connected with the first electrode of the driving transistor; and a control electrode of the fifth switching transistor is connected with the third control signal line, a first electrode of the fifth switching transistor is connected with the second electrode of the driving transistor, and a second electrode of the fifth switching transistor is connected with the first terminal of the light-emitting device.

7. The pixel driving circuit of claim 1, wherein, all the switching transistors in the pixel driving circuit are N-type thin film transistors.

8. A display device, comprising the pixel driving circuit of claim 1.

9. A pixel driving method, wherein, the pixel driving method is applied to the pixel driving circuit of claim 1, and comprises:

outputting a control voltage by the threshold compensation unit to the control electrode of the driving transistor, the control voltage being equal to the sum of only the threshold voltage of the driving transistor and the data voltage of the data line, and driving the light-emitting device by the driving transistor under the control of the control voltage to emit light.

10. The pixel driving method of claim 9, wherein in the pixel driving circuit to which the pixel driving method is applied, the threshold compensation unit comprises a storage capacitor, a reset module, a charging module and a light emission control module; the reset module is connected with a second terminal of the storage capacitor, and is used for resetting the second terminal of the storage capacitor; the charging module is connected with the data line, the first electrode and the second electrode of the driving transistor, and the second terminal of the storage capacitor, and is used for charging the second terminal of the storage capacitor to the control voltage; the light emission control module is connected with the first power supply terminal, the first electrode and the second electrode of the driving transistor, and the first terminal of the light-emitting device, and is used for, when the driving transistor drives the light-emitting device to emit light, connecting the first electrode of the driving transistor to the first power supply terminal, and connecting the second electrode of the driving transistor to the first terminal of the light-emitting device; and a first terminal of the storage capacitor is grounded or is connected with a third power supply terminal, and the second terminal of the storage capacitor is connected with the control electrode of the driving transistor;

the pixel driving method comprises:

in a reset stage, resetting the second terminal of the storage capacitor by the reset module;

in a charging stage, charging, by the charging module, the second terminal of the storage capacitor to the control voltage; and in a display stage, outputting the control voltage by the charging module to the control electrode of the driving transistor, and connecting the first power supply terminal to the first electrode of the driving transistor and connecting the second electrode of the driving transistor to the first terminal of the light-emitting device by the light emission control module.

11. The pixel driving method of claim 10, wherein in the pixel driving circuit to which the pixel driving method is applied, the light emission control module comprises a fourth switching transistor and a fifth switching transistor; a control electrode of the fourth switching transistor is connected with a third control signal line, a first electrode of the fourth switching transistor is connected with the first power supply terminal, and a second electrode of the fourth switching transistor is connected with the first electrode of the driving transistor; and a control electrode of the fifth switching transistor is connected with the third control signal line, a first electrode of the fifth switching transistor is connected with the second electrode of the driving transistor, and a second electrode of the fifth switching transistor is connected with the first terminal of the light-emitting device;

the pixel driving method comprises:

in a reset stage, turning on the first switching transistor, and turning off the second switching transistor, the third switching transistor, the fourth switching transistor and the fifth switching transistor;

in a charging stage, turning on the second switching transistor and the third switching transistor, and turning off the first switching transistor, the fourth switching transistor and the fifth switching transistor; and in a display stage, turning on the fourth switching transistor and the fifth switching transistor, and turning off the first switching transistor, the second switching transistor and the third switching transistor.

* * * * *